United States Patent [19]

Wilson

[11] 4,022,260

[45] May 10, 1977

[54] LAMINATE TRIMMER GUIDE

[76] Inventor: Ralph Wilson, 240 W. 36th, Boise, Idaho 83704

[22] Filed: June 17, 1976

[21] Appl. No.: 697,140

[52] U.S. Cl. ..... 144/134 D; 33/42; 90/12 D

[51] Int. Cl.[2] ..... B27C 5/10

[58] Field of Search ..... 144/134 R, 134 C, 134 D, 144/253 R, 253 D, 253 J, 137; 51/170; 90/12 D; 33/42

[56] References Cited

UNITED STATES PATENTS

| | | | |
|---|---|---|---|
| 2,027,774 | 1/1936 | Hewell | 33/42 |
| 3,478,788 | 11/1969 | Zelik | 144/134 D X |
| 3,893,372 | 7/1975 | Strakeljahn | 144/134 D X |

*Primary Examiner*—Othell M. Simpson
*Assistant Examiner*—W. D. Bray
*Attorney, Agent, or Firm*—Paul F. Horton

[57] ABSTRACT

A laminate trimmer guide including a frame adapted to be hand held for greater precision and control in trimming and an alignment rod of sufficient length to provide vertical alignment of a rotary cutter of a laminate trimmer with the vertical surface of a structural member having a horizontal laminate overlap to be cut.

5 Claims, 3 Drawing Figures

LAMINATE TRIMMER GUIDE

BACKGROUND OF THE INVENTION

1. Field of the Invention

This invention relates in general to alignment guides for laminate trimmers, and in particular to alignment guides providing vertical alignment between a cutting bit and a vertical surface, and even more particularly to vertical alignment guides which are hand held.

2. Description of the Prior Art

The desirability of having alignment guides for cutting devices has long been recognized. Many laminate trimmers utilize a horizontal base member for keeping a transversely located cutting bit at right angles with the horizontal surface of the laminate to be cut. Such an assembly assures a vertically straight cut when the base member is placed flush with a horizontal surface, but does not provide for a vertically aligned cut with a vertical surface of, for example, a splashboard. To meet the need for vertical alignment, a number of vertical alignment guides have been invented and employed for such a purpose. The Burrows invention, U.S. Pat. No. 3,212,541, provides for vertical alignment, but includes a flange portion which prevents tight corner work and in addition has no provisions for direct hand control. More recently, guides have been developed which have a guide rod of substantially the same diameter as the cutting bit. Cordone, U.S. Pat. No. 3,454,061, is of this type. This type of guide serves to control the depth of cut into the laminate, but does not provide vertical alignment, nor does it provide for direct hand control.

BRIEF SUMMARY OF THE INVENTION

The present invention comprises a laminate trimmer guide having a substantially rectangular frame adapted for hand manipulation and a cylindrical alignment rod attached thereto.

It is an object of the present invention, therefore, to provide a laminate trimmer guide which may be hand held and manipulated for increased control and stability.

More particularly, it is an object of the present invention to provide a laminate trimmer guide having thumb detents.

It is also an object of the present invention to provide a laminate trimmer guide providing vertical alignment which is adapted to be hand held.

It is still further an object of the present invention to provide a laminate trimmer guide, adapted to be hand held, which has readily exchangeable vertical cutter alignment rods.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
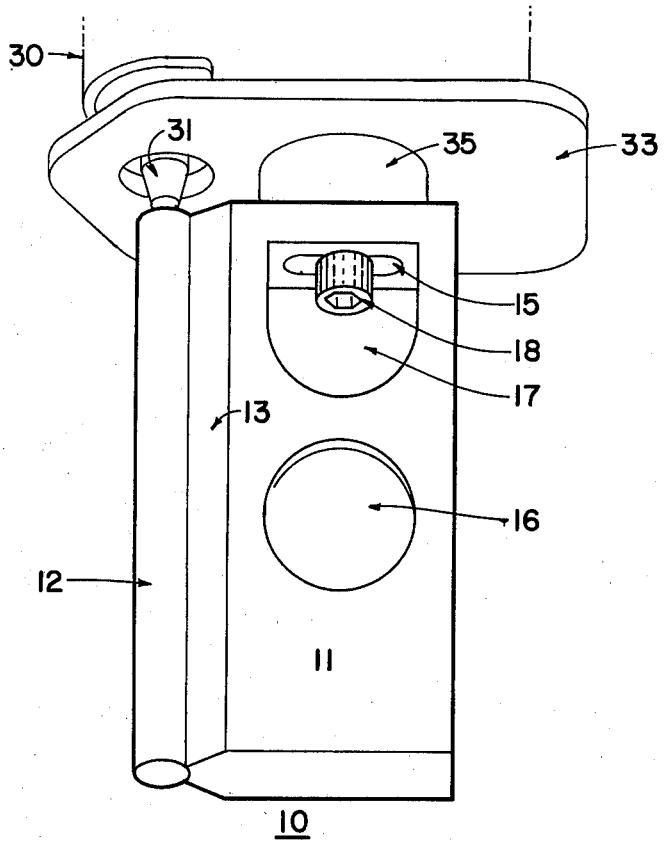
FIG. 1 is a side perspective view of the laminate trimmer guide of the present invention, shown mounted to a laminate trimmer.

Referring now to FIG. 1, a typical embodiment of a laminate trimmer guide, made according to the present invention is disclosed. Laminate trimmer guide 10 is shown mounted on a laminate trimmer 30 having an offset cutting bit 31 extending through a base plate 33. Guide 10 is attached to base plate 33 by means of a spacer 35. Spacer 35 holds guide 10 at a selected distance from base plate 33 and cutting bit 31.

Figure 3:
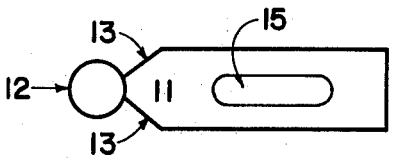
FIG. 3 is a top view showing the slot for attachment of the guide to the trimmer.

Laminate trimmer guide 10 includes a substantially rectangular frame portion 11 and a cylindrical cutter alignment rod 12. Frame 11 includes at its uppermost terminal edge a slot 15, as may be seen in FIG. 3. Guide 10 is attached to base plate 33 of the trimmer by means of screw 18, extending through slot 15 and spacer 35 and into a threaded hole, not shown, of base plate 33. Screw 18 may be tightened, loosened, or removed through lateral opening 17 extending transversely through the sides of frame 11. It is desirable that frame 11 include a beveled portion 13 adjacent the area of frame 11 making contact with rod 12, as shown in FIGS. 1 and 3. The beveled portion 13 permits greater manipulation of the guide and allows closer cutting in corner areas. Frame 11 may be manufactured of any suitable material; aluminum being preferred.

Frame 11 also includes a pair of thumb detents 16, consisting of thumb size indentations recessed approximately one-eighth of an inch into each side of frame 11. It is preferred that the thumb detents be located substantially in the longitudinal center of the sides of frame 11 and somewhat below the latitudinal center.

Figure 2:
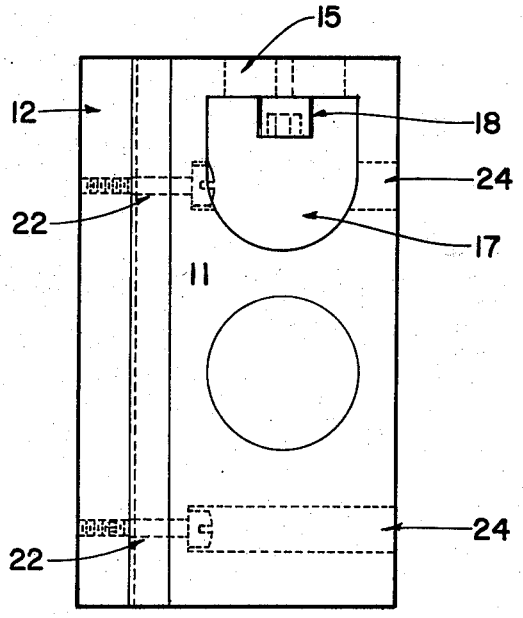
FIG. 2 is a section view of the laminate trimmer guide of the present invention.

Cylindrical cutter alignment rod 12 is attached to the beveled vertical edge of frame 11 by means of screws 22, as may be seen in FIG. 2. Screws 22 are tightened or removed through holes 24 bored transversely from the edge opposite rod 12 and parallel with the sides of frame 11. Holes 24 are coaxially aligned with the screw holes and are of greater diameter for easy removal of the screws. The interior terminal end of holes 24 provide an interior abuttment for the heads of screws 22.

In operation, a rod 12 is selected which has the same diameter as bit 31 of trimmer 30. Rod 12 is then attached to frame 11 by means of attachment screws 22. The assembled guide 10 is then attached to base plate 33 of trimmer 30 by means of screw 18 passing through slot 15 and spacer 35. Guide 10 is positioned so that rod 12 is in axial alignment wth bit 31 and screw 18 is then securely tightened.

Trimmer 30 is then grasped in one hand and guide 10 is grasped with thumb and fingers of the other hand. With power on and cutter bit 31 rotating, the free end of guide 10, and more particularly, the lower end of rod 12 is brought into contact with the vertically extending surface of a splashboard, for example. The operator then gradually tilts the trimmer with attached guide 10 toward the overhanging horizonally disposed laminate and cuts the laminate until contact is made with the upper attached end of the guide. At this point, the cutting bit 31 and the cut laminate are in precise vertical alignment with the vertical surface of the splashboard. The trimmer and attached guide, with rod 12 remaining flush with a vertical surface of the splashboard, is then moved sideways, cutting the laminate in precise vertical alignment with the vertical surface.

Having thus described in detail a preferred embodiment of the present invention, it is to be appreciated and will be apparent to those skilled in the art that many physical changes could be made in the apparatus without altering the inventive concepts and principles embodied therein. The present embodiment is to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A laminate trimmer guide comprising:

a substantially rectangular frame adapted to be hand held and including at its uppermost terminal edge, attachment means for attaching the guide to a base plate of a laminate trimmer, and a cylindrical cutter alignment rod, vertically secured to one edge of said frame parallel with the sides thereof.

2. The laminate trimmer guide as defined in claim 1, further comprising a pair of thumb detents oppositely disposed on opposite planar sides of said frame.

3. The laminate trimmer guide as defined in claim 1, wherein said alignment rod is demountably attached to said frame.

4. The laminate trimmer guide as defined in claim 1, wherein the edge to which said alignment rod is attached is beveled from the area of attachment.

5. A laminate trimmer guide comprising:

a substantially rectangular frame including a pair of thumb detents oppositely disposed on opposite planar sides of said frame and including at its uppermost terminal edge attachment means for attaching the guide to a base plate of a laminate trimmer; and a cylindrical cutter alignment rod demountably attached to one edge of said frame parallel with the sides thereof.

* * * * *